US006769438B2

(12) United States Patent
Fraillon

(10) Patent No.: US 6,769,438 B2
(45) Date of Patent: Aug. 3, 2004

(54) DUAL MIRROR COMPACT

(75) Inventor: Patrick Fraillon, Larchmont, NY (US)

(73) Assignee: Henlopen Manufacturing Co., Inc., Melville, NY (US)

( * ) Notice: Subject to any disclaimer, the term of this patent is extended or adjusted under 35 U.S.C. 154(b) by 240 days.

(21) Appl. No.: 10/121,998

(22) Filed: Apr. 12, 2002

(65) Prior Publication Data

US 2003/0150471 A1 Aug. 14, 2003

Related U.S. Application Data

(60) Provisional application No. 60/355,112, filed on Feb. 8, 2002.

(51) Int. Cl.[7] ..... A45D 33/00; A45D 42/00

(52) U.S. Cl. ..... 132/301; 132/316

(58) Field of Search ..... 132/300, 301, 132/304, 316, 294; 206/823, 235, 772, 774, 769, 581, 731, 542; 359/862; D28/76, 77, 78, 82, 83, 64.1, 64.2; 383/106; D9/418; 220/DIG. 26

(56) References Cited

U.S. PATENT DOCUMENTS 2,128,737 A * 8/1938 Aronstein ..... 132/294
2,215,480 A * 9/1940 Sampson ..... 132/306
3,911,936 A * 10/1975 Kingsford ..... 132/316
5,437,294 A * 8/1995 Ebbets, III et al. ..... 132/304
5,586,653 A * 12/1996 Taveroff ..... 132/316
5,884,636 A * 3/1999 Sheffler et al. ..... 132/295
5,950,640 A * 9/1999 Duncan et al. ..... 132/305

FOREIGN PATENT DOCUMENTS

GB 584388 * 1/1947 ..... A45D/33/00
GB 722834 * 2/1955 ..... A45D/33/00

* cited by examiner

*Primary Examiner*—Kevin Shaver
*Assistant Examiner*—Stephanie L Willatt
(74) *Attorney, Agent, or Firm*—Cooper & Dunham LLP

(57) ABSTRACT

A compact for cosmetics, including a base for holding cosmetic material and a cover hingedly connected to the base in clamshell fashion, with a window formed in one portion of the cover for viewing the cosmetic material, and a first inwardly facing mirror mounted in another portion of the cover so as not to block the window, wherein a second mirror is mounted in the cover for movement between a retracted position underlying the first mirror and an extended position in which the second mirror blocks the window and faces inwardly.

11 Claims, 3 Drawing Sheets

30
16
32
20
44
36
36a
46
22a
24
18
14
28
12
28a
26
11

16
20
42
36
22b
22
44
14
12
11

DUAL MIRROR COMPACT

CROSS REFERENCE TO RELATED APPLICATION

This application claims the benefit of U.S. provisional application No. 60/355,112, filed Feb. 8, 2002, under 35 U.S.C. §119(e).

BACKGROUND OF THE INVENTION

This invention relates to compacts, and in an important specific sense is particularly directed to compacts for containing cosmetics for application by an end user.

For purposes of illustration, the invention will be described herein as embodied in compacts for cosmetics, it being understood, however, that its broader aspects the invention is not limited thereto but may be embodied in compacts for containing other types of materials as well.

Many cosmetics materials, including face powders, foundations, eye shadows, blushes, and some lipsticks and mascaras, are commonly placed (for retail sale and subsequent end use) in containers known as compacts. A conventional compact includes a base formed as a tray with one or more upwardly open recesses for holding the cosmetic material in compressed or like stable condition, and a cover for overlying the base and enclosing the tray to prevent the contents from drying out, becoming contaminated, spilling, or soiling outside objects. One or more brushes, pads such as powder puffs or other implements for applying the cosmetics may also be placed within the compact between the base and cover.

In these conventional compacts, the base and cover are typically molded of plastic or formed of metal, and are hinged together in clamshell fashion along one side of the compact, a manually operable latch being provided on the other side to hold them in closed position. The compact is dimensioned to be held in the hand, and may be square, rectangular, oval, circular, or of other regular or irregular shape. To apply the contained cosmetics, the user opens the compact, draws an applying implement (or a finger) across the cosmetic material held in a recess of the base tray to pick up some of the material, and conveys it on the implement to the appropriate facial area.

Very advantageously, a mirror is provided within the inwardly facing surface of the cover so as to be visible by a user when the compact is open and the user is applying the cosmetic material to the face. Thus, the user can easily and accurately apply the cosmetic when no external mirror is available. The disposition of the mirror within the compact cover is an important feature of convenience in that it enables the user to hold and position both the exposed body of cosmetic material and the mirror in one hand while employing the other hand to manipulate the applicator.

It is frequently desirable to package a compact in a manner enabling retail customers to view the contained cosmetic material at the point of sale without exposing the material to contamination such as can occur if a compact is opened at a store by a prospective purchaser. Accordingly, the compact may be sealed in a transparent plastic film, e.g., in a blister package, with the cover opened to lie flat with the base so that the contents of the compact are clearly visible through the blister film. A problem with this type of packaging, however, is that the area of the package must ordinarily be at least twice the area of the closed compact, because the base and cover lie open at 180°, or approximately at 180°, to each other; hence the packages occupy undesirably large amounts of shelf or display space.

Expedients heretofore proposed to reduce the area occupied by compacts in blister-package or like displays have included the provision of special articulated hinges connecting the cover and base to enable the cover to turn 360° into a position underlying the base. These expedients are more or less structurally complicated, adding to manufacturing cost and complexity, and may present difficulties in manipulation for the end user.

Other possible arrangements for enabling point-of-purchase viewing of the contents of a compact would require elimination or at least a reduction in size of the interior cover mirror with consequent loss of its beneficial attributes of ease and convenience in application of cosmetics. As described for example in U.S. Pat. No. 3,911,936, it has been proposed to provide a compact having a cover in which a window for viewing the contents, and an inwardly facing mirror for use in applying the contents, are disposed side by side. While this arrangement allows purchasers to see the color (shade) of the cosmetic product they are buying, without opening the cover, the size of the mirror is unavoidably and undesirably decreased (as compared with the mirror size in a windowless compact cover of the same dimensions) to accommodate the window. A further disadvantage is that as the contents of the compact become partially consumed, the interior of the compact may become unsightly but is still visible through the window.

SUMMARY OF THE INVENTION

An object of the invention is to provide a new and improved cosmetic material container of the type comprising a compact, enabling point-of-purchase visibility of the contained cosmetic in a manner that avoids the above-discussed difficulties. A particular object is to provide such a container enabling the cosmetic material to be visible at the point of purchase, and at the same time providing a size or area of inwardly-facing mirror on the cover of the compact that is equivalent to that available on a windowless compact cover of the same dimensions. Yet another object is to provide such a container wherein the window is blocked once the product begins to be used, concealing potentially unsightly conditions in the interior of the compact. A further object is to provide such a container as a pre-assembled unit.

To these and other ends, the present invention broadly contemplates the provision of a compact for holding cosmetics or the like, including a base for containing a quantity of cosmetic material, and a cover hingedly connected to the base and having an extended area with an inner surface and an outer surface, the cover carrying a window through which contained cosmetic material can be viewed, disposed in a first portion of the extended area, and an inwardly-facing first mirror, mounted on the inner surface in a second portion of the extended area so as not to block the window, wherein a second mirror is mounted in the cover inwardly of the inner surface for movement from a retracted position in which the second mirror underlies and at least partially blocks the first mirror without blocking the window, to an extended position in which the second mirror underlies and blocks the window while exposing the first mirror for use when the cover is open, the second mirror being inwardly-facing at least in the extended position.

As a further feature of the invention, in currently preferred embodiments, the cover carries a detent that engages the second mirror to retain the second mirror in the extended position. The detent may comprise at least one rib formed integrally with the cover, and may permanently lock the second mirror in the extended position when the second mirror is moved from the retracted position into the extended position.

The second mirror (or the structure supporting and movably mounting it within the cover) may have a decorative outer surface or picture holder visible through the window when the second mirror is in the extended position. Also, one of the first and second mirrors may be an ordinary mirror and the other may be a magnifying mirror.

In certain embodiments, the second mirror has an edge along which it is hingedly connected to the cover for pivotal movement through substantially 180° from its retracted position to its extended position. The compact in these embodiments conveniently or preferably includes a bezel having a first portion for mounting the first mirror, and a second portion for mounting the second mirror, the first and second portions of the bezel being hingedly connected together and the first portion of the bezel being fixedly mounted in the cover at the inner surface thereof. The second portion of the bezel, in such embodiments, may be provided with the aforementioned decorative outer surface visible through the window when the second mirror is in the open position.

Alternatively, the second mirror may be mounted in the cover for sliding movement from the retracted position to the extended position. For instance, the compact structure may include a tray slidably mounted in the cover and carrying the second mirror.

In the compact of the invention, the transparent window in the cover enables point-of-purchase viewing of the contents of the compact with the compact closed (and thus occupying minimal shelf or counter area), while the movable second mirror, initially underlying the first mirror to leave the window unoccluded, cooperates (when moved to the extended position) with the first mirror to provide a total area of inwardly-facing mirror comparable to that available in a windowless compact cover.

The opacity (and preferably decorative) outwardly-facing surface of the second mirror or its mounting and support structure, visible through the transparent window of the compact cover when the second mirror is in the extended position, afford further features of advantage, especially from an aesthetic standpoint. As the compact is used, its interior with the contained applicator and partially consumed contents might be unsightly if visible through a transparent cover. Not only does the insert member conceal the compact interior, but in addition, the decorative insert surface seen through the cover contributes positively to the attractiveness of appearance of the compact.

Further features and advantages of the invention will be apparent from the detailed description hereinbelow set forth, together with the accompanying drawings.

DETAILED DESCRIPTION

Figure 1:
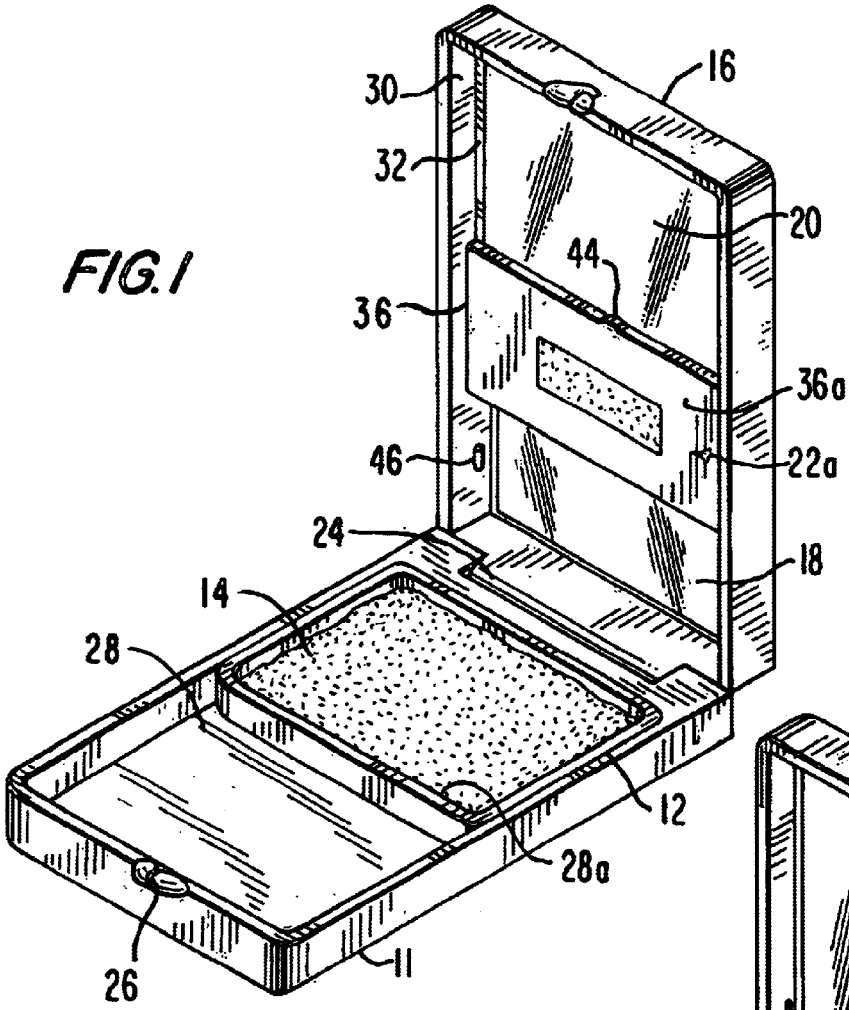
FIG. 1 is a perspective view of a compact embodying the present invention in a particular form, showing the lid open and the second mirror in retracted position.
Figure 2:
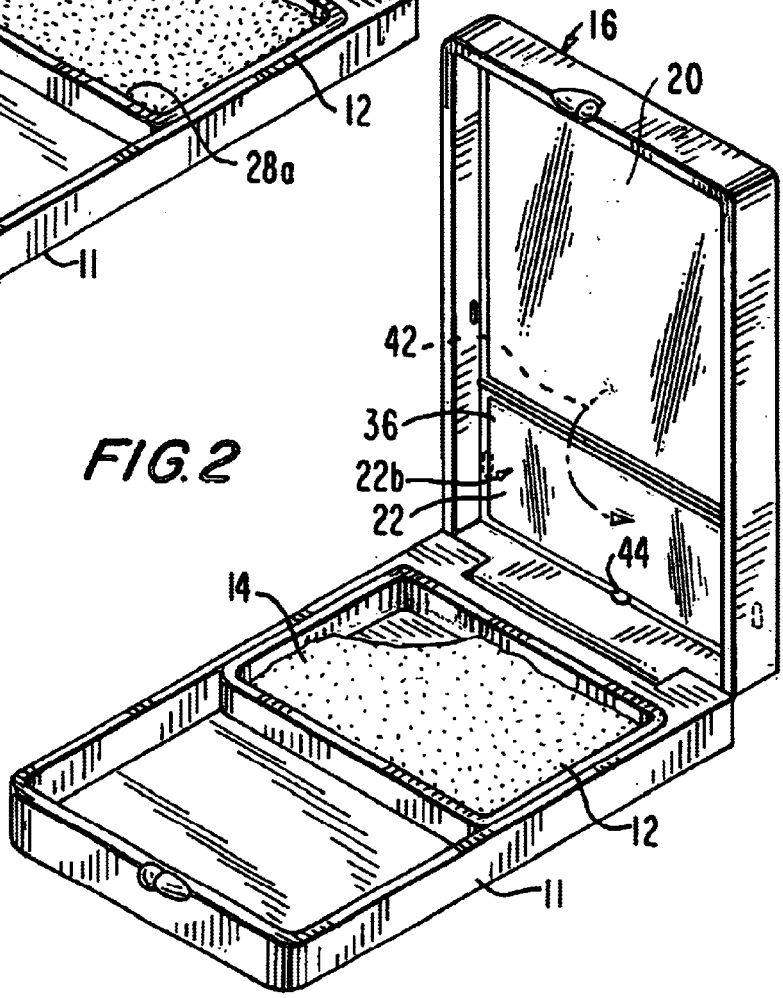
FIG. 2 is a view similar to FIG. 1 but showing the second mirror in extended position.
Figure 3:
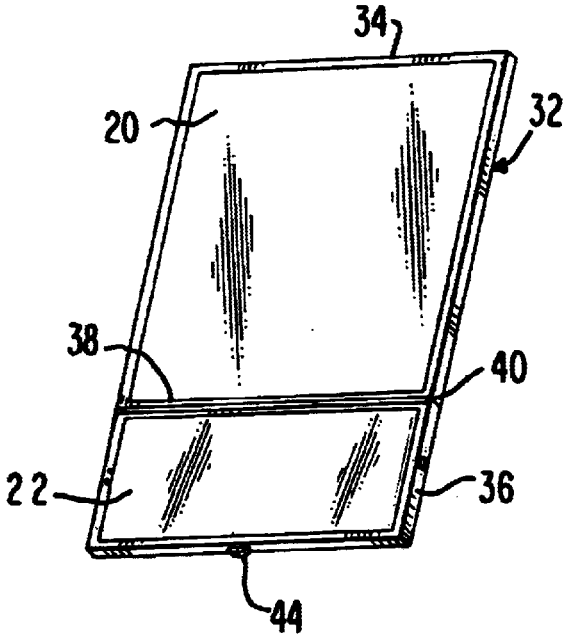
FIG. 3 is a perspective view of a bezel structure mounting the mirrors in the compact of FIGS. 1 and 2.

In FIGS. 1–3, the invention is illustrated as embodied in a compact 10 of generally rectangular plan configuration, dimensioned to be held in a user's hand, for holding a cosmetic material such as powder, blush or the like for application to the face. The compact 10 includes a base 11 formed or provided with a tray 12 containing a quantity of cosmetic material 14, and a cover 16 hingedly connected to the base and having an extended area with opposed inner and outer surfaces, i.e., surfaces respectively facing toward and away from the interior of the compact when the cover is in closed position overlying the base. The cover carries a transparent window 18 disposed in a first portion of the extended area, and an inwardly facing first mirror 20, mounted on the inner surface of the cover in a second portion of the extended area so as not to block the window, which serves to enable a prospective end user to view the color (shade) of the contained cosmetic, e.g. at a point-of-purchase display, without opening the compact.

In accordance with the invention, and as a particular feature thereof, a second mirror 22 is mounted in the cover inwardly of the inner surface for movement from a retracted position 22*a* (FIG. 1) in which the second mirror underlies and at least partially blocks the first mirror without blocking the window 18, to an extended position 22*b* (FIG. 2) in which the second mirror underlies and blocks the window while exposing the first mirror for use when the cover is open. The second mirror faces inwardly (in the same direction as the first mirror) at least in the extended position 22*b*.

More particularly, in the compact of FIGS. 1–3 the base 11 and cover 16 are of identical rectangular plan diameter (though they may differ in depth), interconnected along one edge portion by a hinge 24 and provided on an opposite edge portion with a latch 26 for holding the cover in closed position on the base. The hinge and latch may be entirely conventional in structure, function and location.

The base and cover are substantially rigid and are self-sustaining in shape. They may be fabricated in a generally conventional manner of materials conventionally used for such purposes, provided that, as stated, the cover 16 carries transparent portion or window 18 molded or fixedly assembled into it for enabling a prospective user at a point-of-purchase display to see the color (shade) of the contained cosmetic material, without opening the compact or the transparent packaging in which the compact may be enclosed. Conveniently, the cover apart from the window is a molded opaque plastic element, with an aperture in which the window (itself typically a molded transparent plastic member) is molded or fixedly assembled so as to constitute an effectively integral part of the cover for enclosing the cosmetic-containing interior of the compact. The base is also an element molded of opaque plastic.

In common with conventional compacts, the cosmetic-holding tray 12 of the base 11 may include a molded plastic element 28 fixedly mounted e.g. by snap fitting or sonic-welded assembly in the interior of the base to define at least one recess 28*a*, opening upwardly within the interior of the compact, for holding a quantity of compressed powdered cosmetic material 14; alternatively, the base may be a one-piece base (not shown) which has no platform and itself serves to hold the cosmetic material. Also in common with conventional compacts, the compact is ordinarily carried by the user with the cover member closed and latched over the base member so as to enclose the contained cosmetics. For applying the cosmetics, the compact is opened to expose the cosmetic-holding recess of the tray; the user then removes a portion of a the contained cosmetic material with a powder puff or like pad, brush or other implement (not shown), or a finger, and applies it to her face. To facilitate such operation, the hinge permits the cover to move, in opening, through an angle of at least about 90° relative to the base; commonly, the cover is movable to a full-open position at an angle of 180° relative to the base.

The cover 16, in the form shown, has the shape of a shallow rectangular inverted pan, with a planar lip or edge flange 30 extending inwardly (toward the interior of the compact) entirely around the central portion. Thus, the cover may be considered to have a recessed planar inner surface facing the interior of the compact. The window 18, in the specific design shown, extends entirely across the width of the cover and for less than half of the length of the cover, occupying the portion of the cover area closest to hinge 24; the inwardly facing first mirror 20 occupies substantially the entire remainder of the area of the cover on the inner surface thereof. The proximate edges of the first mirror and the window lie along a line parallel to the width of the cover. It will be appreciated that these specific features of configuration and arrangement are merely illustrative and are non-limiting.

As best seen in FIG. 3, the first and second mirrors are mounted in a bezel 32, which is a rectangular structure formed in two parts 34 and 36 pivotally interconnected along a common straight edge 38 by a molded-in living hinge or pinned hinge 40. The first mirror 20 is glued to the upper part 34 of the bezel, and the second mirror 22 is glued to the lower part of the bezel.

The upper part of the bezel is permanently mounted inside the compact cover 16, clear of the window 18, thereby securing the first mirror 20 inside the cover with the specularly reflective surface of the mirror 20 facing inwardly. When the bezel is thus mounted in the cover 16, the axis of rotation of bezel part 36 relative to bezel part 34 about hinge 40 is parallel to and substantially in register with the aforementioned proximate edges of the first mirror and window. The lower part 36 of the bezel is initially secured to the cover 16 only by its hinged or pivotal connection to the upper part of the bezel, and is folded up in the retracted position 22*a* of FIG. 1, such that the second mirror 22 underlies and partially covers the first mirror 20. In this retracted position, the specularly reflective surface of the mirror 22 faces outwardly, toward (and in juxtaposed relation to) the first mirror 20, while the nonreflective back surface of the mirror 22 or bezel part 36 faces inwardly. The mirror 22 and its associated bezel part 36 in position 22*a* are entirely clear of the window, enabling unobstructed viewing of the contained cosmetic through the window when the compact is closed and latched.

For initial use of the compact, the user unlatches and opens the compact, exposing the interior of the cover and base as shown in FIGS. 1 and 2. The user then manually rotates the bezel part 36 carrying the second mirror 22 about the hinge 40 through substantially 180° (as indicated by arrow 42 in FIG. 2), to the extended position 22*b* of FIG. 2. A tab 44 may be formed integrally in an edge portion of the bezel part 36 to facilitate this manipulative operation.

In the extended position, the specularly reflective surface of the mirror 22, like that of mirror 20, faces inwardly. The mirror 22 and bezel part 36 underlie (occlude or block) the window 18, preventing the interior of the compact from being viewed through the window; at the same time, the mirror 22 and bezel part 36 are entirely clear of the first mirror 20, so that substantially the entire inner surface area of the compact cover 16, including the area occupied by window 18 as well as that occupied by the first mirror 20, becomes a usable mirror. That is to say, once the second mirror and its bezel part have been rotated into the extended position, the area of the second mirror is added to that of the first mirror to constitute the total mirror area available for use in applying the contained cosmetic.

Advantageously, one or more ribs 46 are molded in the cover 16 in position to engage and permanently lock the bezel part 36 carrying the second mirror 22, as the second mirror is rotated into the extended position. At this time, the compact having been purchased and initially opened, there is no longer a need for a viewing window in the cover, and the locking of the second mirror in extended position secures it for use as a part of the mirror system (side-by-side mirrors 20 and 22) within the cover.

The two mirrors 20 and 22 may, for example, be ordinary (non-magnifying) mirrors, functioning as two adjacent panels of a single mirror. Alternatively, either one of the two mirrors may be an ordinary mirror while the other is a magnifying mirror, adding versatility to the compact mirror array.

The back surface 36*a* of the rotatably mounted bezel lower part 36 may be decorated, engraved or serve as a picture holder. The decoration, engraving or picture is visible through the window 18 once the bezel part 36 and mirror 22 have been unfolded into the extended position.

Figure 4:
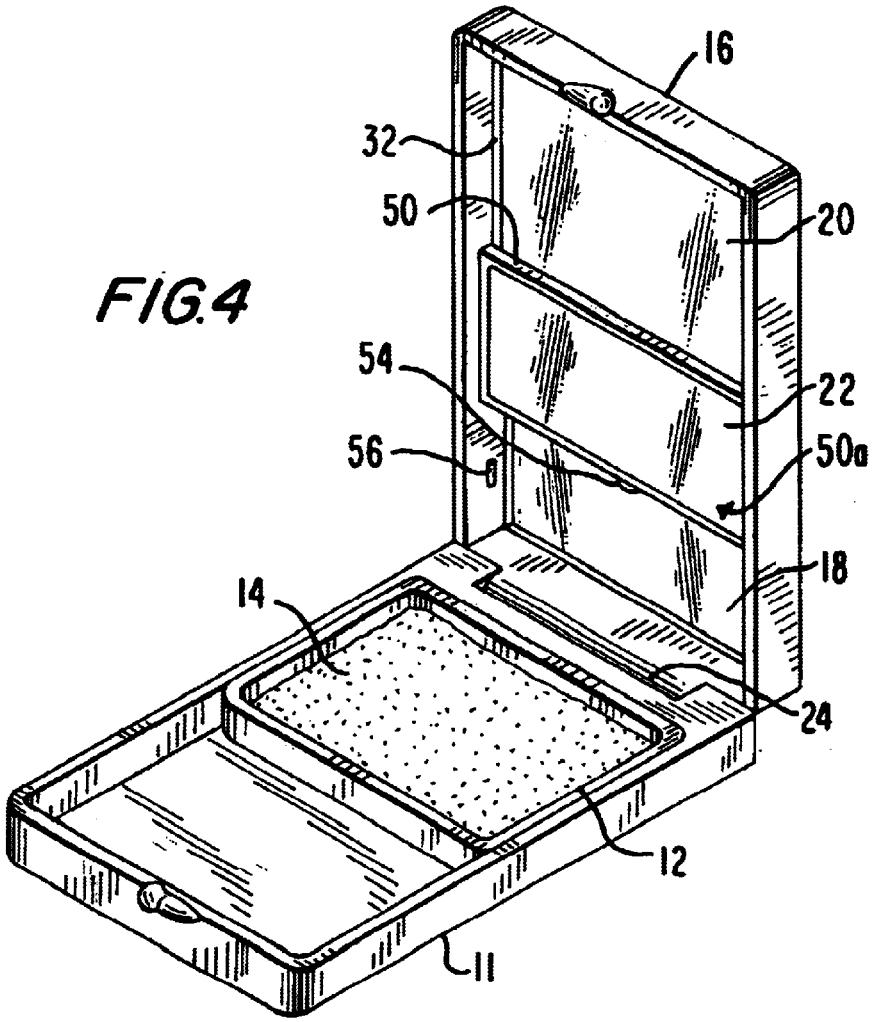
FIG. 4 is a perspective view of another embodiment of the compact of the invention, again showing the lid open and the second mirror in retracted position.
Figure 5:
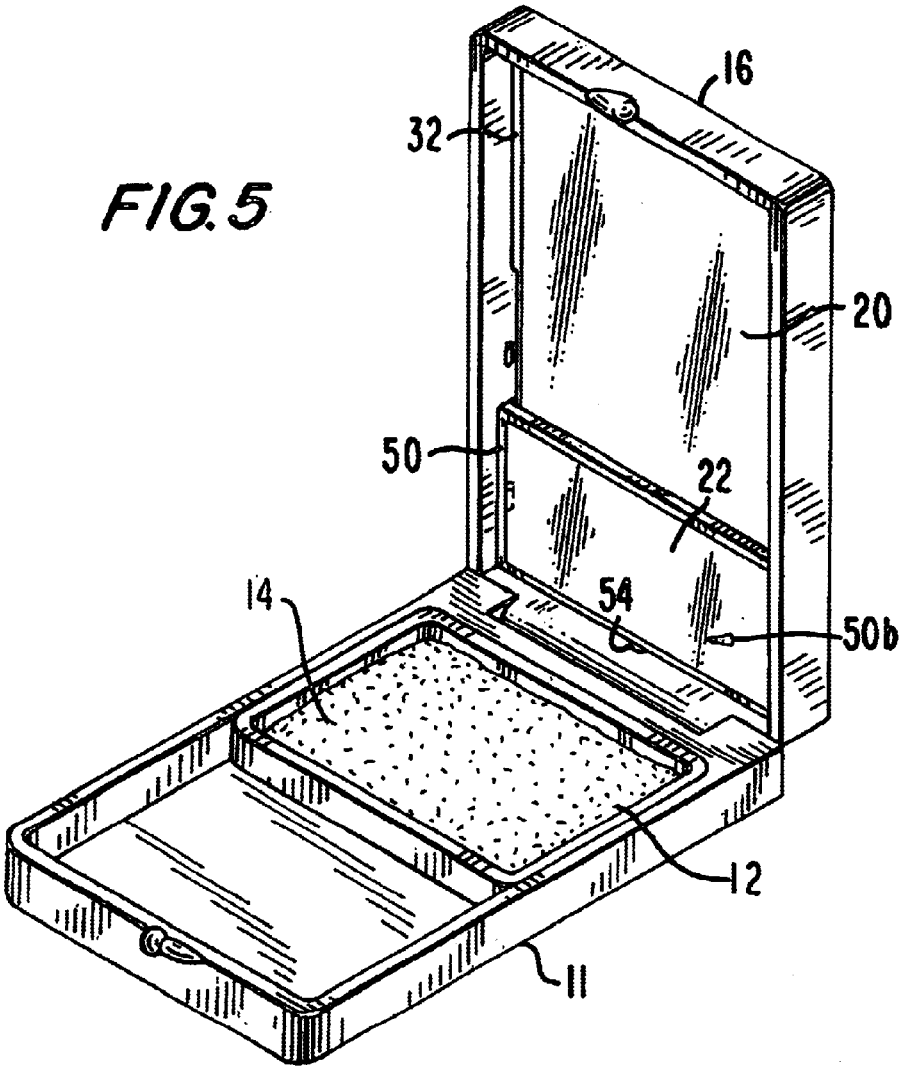
FIG. 5 is a view similar to FIG. 4 but showing the second mirror in extended position.
Figure 6:
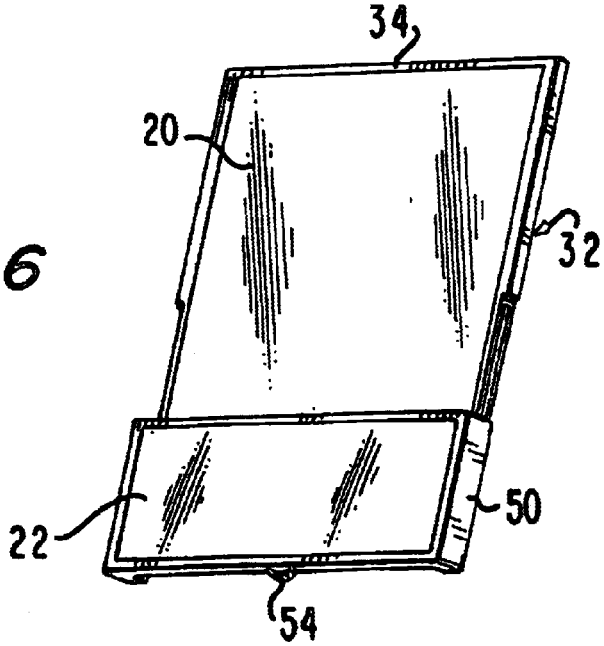
FIG. 6 is a perspective view of mounting structure for the mirrors in the compact of FIGS. 4 and 5.

In the alternative embodiment of FIGS. 4–6, wherein like parts have the same reference numerals as in FIGS. 1–3, the hinged lower part 36 of the bezel 32 is replaced by a sliding tray 50 on which the second mirror 22 is glued. As before, the first mirror 20 is glued to bezel part 34 which is in turn fixedly mounted in the cover 16 with mirror 20 in the same location, relative to window 18, as in FIGS. 1 and 2. The sliding tray is assembled in the compact cover for guided movement from a retracted position 50*a* in which the tray and mirror 22 underlie the first mirror 20 and are clear of the window (FIG. 4) to an extended position 50*b* in which the tray and mirror 22 are clear of the mirror 20 but underlie and occlude the window (FIG. 5), both mirrors 20 and 22 being fully exposed in side-by-side relation so that their combined areas constitute the useful specularly reflective area in the cover.

For initial use of this compact, the user opens the compact and manually slides the tray 50 downwardly (as seen in the drawings) toward the hinge 24 to move the second mirror from the retracted position to the extended position, conveniently with the aid of a tab 54 formed in the tray 50. Again, one or more ribs 56 are molded in the cover 16 in position to engage and permanently lock the tray 50 carrying the second mirror 22, as the second mirror is slid into the extended position.

The embodiment of FIGS. 4–6 is generally similar to that of FIGS. 1–3 except that the second mirror is moved by sliding rather than rotation, and its specular surface always faces inwardly. The back surface of the tray 50 (visible through the window 18 in the extended position) may be ornamentally decorated. One mirror or the other may be a magnifying mirror if desired.

As supplied by a cosmetic manufacturer to the retail marketplace, the compact is provided with a body 14 of cosmetic material filling the tray of the base, and the cover is in closed position, protecting the contents. At this time, the second mirror 22 is in the retracted position (22*a* in FIG. 1 or 50*a* in FIG. 4). The cosmetic material in the base is therefore visible, to prospective purchasers, through the unobstructed window 18 molded or fixedly assembled in the compact cover 16. In this way, effective point-of-purchase viewing of the contained cosmetic is achieved with minimal display space (because the compact is closed) and without resort to complicated and costly invertible covers or the like.

After the compact has been purchased and removed from its packaging, the user opens the compact and manually moves the bezel part 36 or tray 50 holding the second mirror 22 into the extended position shown in FIGS. 2 and 5, where it is thereafter securely held by engagement with the ribs formed in the cover. Owing to the opacity of this bezel part or tray, the interior of the compact is now no longer visible through the window 18, but the decorative outer surface 34 of the insert member is visible through the window, contributing to the aesthetic appearance of the compact.

It is to be understood that the invention is not limited to the features and embodiments hereinabove specifically set forth, but may be carried out in other ways without departure from its spirit.

What is claimed is:

1. A compact for holding cosmetics or the like, including:

(a) a base for containing a quantity of cosmetic material; and (b) a cover hingedly connected to the base and having an extended area with an inner surface and an outer surface, the cover carrying (i) a window through which contained cosmetic material can be viewed, disposed in a first portion of the extended area, and (ii) an inwardly-facing first mirror, mounted on the inner surface in a second portion of the extended area so as not to block the window;

wherein the improvement comprises:

(c) a second mirror, mounted in the cover inwardly of said inner surface for movement from a retracted position in which the second mirror underlies and at least partially blocks the first mirror without blocking the window, to an extended position in which the second mirror underlies and blocks the window while exposing the first mirror for use when the cover is open, said second mirror being inwardly-facing at least in the extended position.

2. A compact as defined in claim 1, wherein the cover carries a detent that engages the second mirror to retain the second mirror in the extended position.

3. A compact as defined in claim 2, wherein the detent comprises at least one rib formed integrally with the cover.

4. A compact as defined in claim 2, wherein the detent permanently locks the second mirror in the extended position when the second mirror is moved from the retracted position into the extended position.

5. A compact as defined in claim 1, wherein the second mirror has a decorative outer surface, or a holder for a picture, visible through the window when the second mirror is in the extended position.

6. A compact as defined in claim 1, wherein one but not both of the first and second mirrors is a magnifying mirror.

7. A compact as defined in claim 1, wherein the second mirror has an edge and is hingedly connected to the cover along said edge for pivotal movement through substantially 180° from said retracted position to said extended position.

8. A compact as defined in claim 7, further including a bezel having a first portion for mounting the first mirror, and a second portion for mounting the second mirror, the first and second portions of the bezel being hingedly connected together and the first portion of the bezel being fixedly mounted in the cover at the inner surface thereof.

9. A compact as defined in claim 8, wherein the second portion of the bezel has a decorative outer surface visible through the window when the second mirror is in the open position.

10. A compact as defined in claim 1, wherein the second mirror is mounted in the cover for sliding movement from the retracted position to the extended position.

11. A compact as defined in claim 10, further including a tray slidably mounted in the cover and carrying the second mirror.

* * * * *